US009733581B2

(12) United States Patent
Inagaki et al.

(10) Patent No.: US 9,733,581 B2
(45) Date of Patent: Aug. 15, 2017

(54) ELECTROPHOTOGRAPHIC PHOTORECEPTOR, ELECTROPHOTOGRAPHIC IMAGE FORMING METHOD AND ELECTROPHOTOGRAPHIC IMAGE FORMING APPARATUS

(71) Applicant: Konica Minolta, Inc., Tokyo (JP)

(72) Inventors: Keiichi Inagaki, Hino (JP); Toshiyuki Fujita, Hachioji (JO); Mari Konishi, Mitaka (JP); Daisuke Kodama, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/727,149

(22) Filed: Jun. 1, 2015

(65) Prior Publication Data

US 2015/0355562 A1 Dec. 10, 2015

(30) Foreign Application Priority Data

Jun. 6, 2014 (JP) ..... 2014-117418

(51) Int. Cl.

| | |
|---|---|
| ***G03G 5/08*** | (2006.01) |
| ***G03G 5/147*** | (2006.01) |
| ***G03G 5/087*** | (2006.01) |
| ***G03G 5/05*** | (2006.01) |
| ***G03G 5/10*** | (2006.01) |

(52) U.S. Cl.

CPC ..... *G03G 5/087* (2013.01); *G03G 5/0507* (2013.01); *G03G 5/08* (2013.01); *G03G 5/102* (2013.01); *G03G 5/147* (2013.01)

(58) Field of Classification Search

CPC ..... G03G 5/0507; G03G 5/08; G03G 5/102
USPC ..... 430/58.1, 57.7, 58.75
See application file for complete search history.

(56) References Cited

FOREIGN PATENT DOCUMENTS

| | | | |
|---|---|---|---|
| JP | 4-281461 | * | 7/1992 |
| JP | 2013061625 | A | 4/2013 |
| JP | 2013130603 | A | 7/2013 |
| JP | 2014021133 | A | 2/2014 |
| JP | 2015169870 | A | 9/2015 |
| JP | 2015175937 | A | 10/2015 |

OTHER PUBLICATIONS

Machine Translation of JP2014-021133, pp. 1-31, published on Feb. 3, 2014.*

Machine Translation of JP2013-130603, pp. 1-19, published on Jul. 4, 2013.*

Notification of Reason(s) for Refusal dated Jul. 26, 2016 from the corresponding Japanese Application; Patent Application No. 2014-117418; English translation of Notification of Reason(s) for Refusal; Total of 9 pages.

* cited by examiner

*Primary Examiner* — Thorl Chea
(74) *Attorney, Agent, or Firm* — Lucas & Mercanti, LLP

(57) ABSTRACT

An electrophotographic photoreceptor includes: a conductive holder; and at least a charge producing layer and a charge transport layer disposed on the conductive holder in order. The charge transport layer contains at least a binder resin, a charge transport agent and a p-type metal oxide particle.

4 Claims, 1 Drawing Sheet

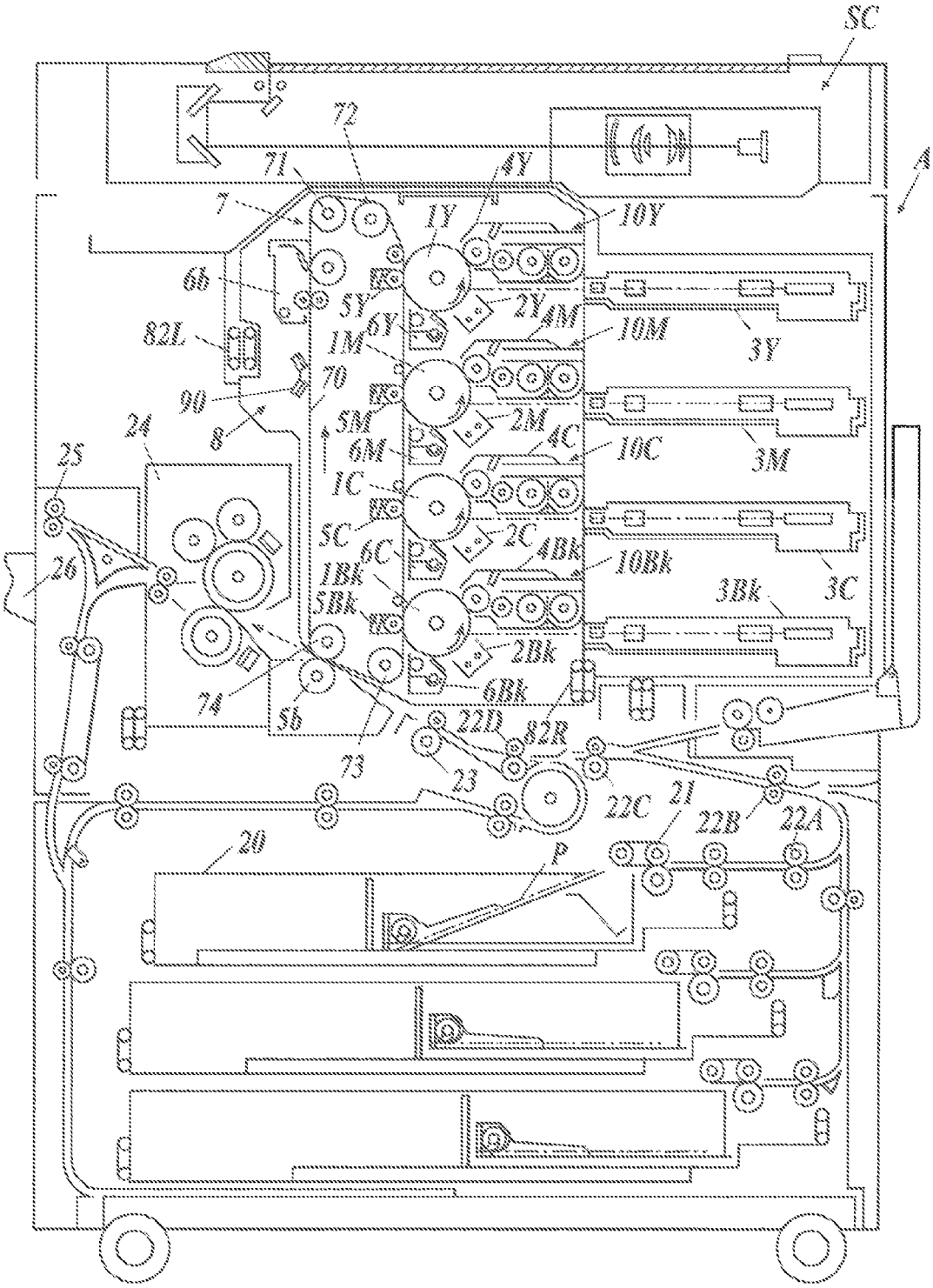
SC
A
72
71
7
4Y
1Y
10Y
6b
5Y
2Y
6Y
4M
10M
3Y
82L
1M
70
90
8
5M
2M
6M
4C
10C
3M
24
25
1C
5C
2C
6C
4Bk
10Bk
3C
26
1Bk
5Bk
3Bk
2Bk
6Bk
74
5b
22D
82R
73
23
22C
21
22B
22A
20
P

ELECTROPHOTOGRAPHIC PHOTORECEPTOR, ELECTROPHOTOGRAPHIC IMAGE FORMING METHOD AND ELECTROPHOTOGRAPHIC IMAGE FORMING APPARATUS

FIELD OF THE INVENTION

The present invention relates to an electrophotographic photoreceptor, an electrophotographic image forming method and an electrophotographic image forming apparatus, in particular an electrophotographic photoreceptor, an electrophotographic image forming method and an electrophotographic image forming apparatus to realize high durability by increasing film strength while maintaining electrical characteristics of a charge transport layer.

DESCRIPTION OF THE RELATED ART

As an electrophotographic photoreceptor (hereinafter may be simply referred to as a "photoreceptor") used in an electrophotographic image forming apparatus, there have been known an inorganic photoreceptor and an organic photoreceptor.

The "electrophotographic" (or "electrophotography") means, in general, an image forming process of: charging a photoconductive photoreceptor, for example, by corona discharge at a dark place; exposing the photoreceptor; producing an electrostatic latent image by selectively dissipating charges of only the exposed part; and developing the latent image part with a toner composed of a colorant such as a dye or a pigment, a resin material and so forth so as to make it visible, thereby forming an image.

Organic photoreceptors have advantages in degree of freedom of a photosensitive wavelength region, film formability, flexibility, film transparency, mass productivity, toxicity, costs and so forth as compared with inorganic photoreceptors. Hence, currently, organic photoreceptors are used as most of photoreceptors.

Photoreceptors have been required to have high durability in view of environmental load reduction, productivity increase, cost reduction and so forth.

In recent years, provision of a surface layer (also called a protective layer) on a charge transport layer is the mainstream to increase durability of a photoreceptor. The provision of a surface layer is effective to increase durability, but increase the number of production steps and reduce the yield.

Further, use of curable resin for a surface layer in order to further increase durability has been an active area of research.

According to, for example, Japanese Patent Application Publication No. 2013-061625, there has been proposed a photoreceptor composed of a surface layer containing: UV curable resin; reactive treatment filler composed of conductive particles of, for example, tin oxide; and a charge transport agent.

However, when UV curable resin is used, many limitations are imposed on a charge transport agent usable together with the UV curable resin. That is, a charge transport agent having a short conjugated system is needed so that UV can well pass through. This sort of charge transport agent is lower in charge transport function (mobility) than a charge transport agent generally used for a charge transport layer. In addition, when different charge transport agents are used for a surface layer and a charge transport layer, an interface is formed between the surface layer and the charge transport layer (injection barrier), whereby charges cannot be smoothly transported from the charge transport layer to the surface layer, which reduces electrical characteristics.

In order not to form the injection barrier, addition of a charge transport agent which is the same as that used for the charge transport layer to the surface layer is effective, but it causes film quality reduction. That is, in order to use, for the surface layer, a charge transport agent which is the same as that used for the charge transport layer, naturally, a solvent in which the charge transport agent is dissolved is used, so that the charge transport agent of the charge transport layer is eluted toward the surface layer, and film strength significantly decreases.

Further, if a large amount of a charge transport agent which acts as a plasticizer is added in order to ensure electrical characteristics, film strength of the charge transport layer decreases.

Improvement in the charge transport layer realizes high durability without reducing electrical characteristics, and generally-known techniques therefor are to increase the molecular weight of a binder resin and to add filler.

However, increase in the molecular weight of a binder resin increases the viscosity of an application liquid, thereby decreasing the application speed of the application liquid applied by general immersion coating for a predetermined thickness and reducing productivity.

The productivity can be maintained by reducing the solid content of the application liquid and accordingly reducing the viscosity thereof. However, because the solid content is low, a thick applied film needs to be formed in order to obtain a predetermined thickness. The thick applied film requires a longer time to be dried. Thus, uniform application is difficult.

Further, realization of high durability by addition of filler is relatively easy. However, the filler conventionally used has no charge transport function and does not sufficiently demonstrate the effects, namely, electrical characteristics and high durability.

BRIEF SUMMARY OF THE INVENTION

The present invention has been conceived in view of the above problems and circumstances, and hence objects of the present invention include providing an electrophotographic photoreceptor, an electrophotographic image forming method and an electrophotographic image forming apparatus to realize high durability by increasing film strength while maintaining electrical characteristics of a charge transport layer.

The present inventors have examined the causes and so forth of the above problems in order to achieve the above objects and found out that a part of a charge transport agent, which is a cause of film strength decrease, being replaced by p-type metal oxide particles can significantly increase film strength because of decrease in the amount of the charge transport agent and addition of the filler and thereby realize high durability while maintaining electrical characteristics of the charge transport layer. Thus, the present inventors have arrived at the present invention.

That is, the above objects of the present invention are achieved by the following means.

1. An electrophotographic photoreceptor including: a conductive holder; and at least a charge producing layer and a charge transport layer disposed on the conductive holder in order, wherein the charge transport layer contains at least a binder resin, a charge transport agent and a p-type metal oxide particle.

2. The electrophotographic photoreceptor according to the item. 1, wherein the p-type metal oxide particle contains at least one type of a compound selected from $CuAlO_2$, $CuGaO_2$, $CuInO_2$ and $Cu_2O$.

3. An electrophotographic image forming method including using the electrophotographic photoreceptor according to the item 1.

4. An electrophotographic image forming apparatus including the electrophotographic photoreceptor according to the item 1.

BRIEF DESCRIPTION OF THE SEVERAL VIEWS OF THE DRAWING

The present invention is fully understood from the detailed description given hereinafter and the accompanying drawing(s), which are given byway of illustration only and thus are not intended to limit the present invention, wherein:

FIGURE 1 is a cross sectional view showing an example of the configuration of an image forming apparatus of the present invention.

DETAILED DESCRIPTION OF THE INVENTION

An electrophotographic photoreceptor of the present invention includes: a conductive holder; and at least a charge producing layer and a charge transport layer disposed on the conductive holder in order, wherein the charge transport layer contains at least a binder resin, a charge transport agent and a p-type metal oxide particle(s).

As an embodiment of the present invention, in view of the effects of the present invention to be demonstrated, the p-type metal oxide particle contains at least one type of a compound selected from $CuAlO_2$, $CuGaO_2$, $CuInO_2$ and $Cu_2O$, which are preferable because of their performance and being abundant elements.

The electrophotographic photoreceptor of the present invention is suitably used in an electrophotographic image forming method.

The electrophotographic photoreceptor of the present invention is suitably used in an electrophotographic image forming apparatus.

Hereinafter, the present invention, its components, and forms/modes for carrying out the present invention are detailed. Note that in this application, "-(to)" between values is used to mean that the values before and after the sign are inclusive as the lower limit and the upper limit.

[Electrophotographic Photoreceptor]

The electrophotographic photoreceptor of the present invention includes at least a charge producing layer and a charge transport layer disposed on a conductive holder in order, wherein the charge transport layer contains at least a binder resin, a charge transport agent and p-type metal oxide particles.

The photoreceptor of the present invention is not particularly limited as long as at least a charge producing layer and a charge transport layer which constitute a photosensitive layer are disposed on a conductive holder in order. Examples of the layer structure include the following layer structure (1).

(1) A layer structure composed of an intermediate layer, a charge producing layer and a charge transport layer disposed on a conductive holder in this order.

The photoreceptor of the present invention is an organic photoreceptor. The organic photoreceptor means an electrophotographic photoreceptor with at least one of a charge producing function and a charge transport function, necessary for an electrophotographic photoreceptor, realized by an organic compound. Examples of the organic photoreceptor include: a photoreceptor composed of a well-known organic charge producing substance or organic charge transport substance; and a photoreceptor with the charge producing function and the charge transport function realized by a polymer complex.

Hereinafter, the structure of the photoreceptor of the present invention is described with the above layer structure (1).

<Conductive Holder>

The conductive holder of the photoreceptor of the present invention is not particularly limited as long as it has conductivity. It is preferable that the conductive holder have a specific resistance of $10^3$ Ω/cm or less at room temperature. Examples thereof include: a conductive holder formed of a metal, such as aluminum, copper, chromium, nickel, zinc or stainless steel, in the shape of a drum or sheet; a conductive holder formed of a foil of a metal, such as aluminum or copper, and a plastic film laminated with the foil; a conductive holder formed of aluminum, indium oxide or tin oxide deposited on a plastic film; and a conductive holder formed of a conductive substance only or together with a binder resin applied to a metal, a plastic film or paper so as to form a conductive layer thereon.

<Intermediate Layer>

The photoreceptor of the present invention may be provided with the intermediate layer having a barrier function and an adhesion function between the conductive holder and the photosensitive layer. In consideration of prevention of various faults or the like, it is preferable to provide the intermediate layer.

The intermediate layer contains a binder resin (hereinafter may be referred to as an "intermediate layer binder resin") and contains conductive particles or metal oxide particles as needed.

Examples of the intermediate layer binder resin include casein, polyvinyl alcohol, nitrocellulose, ethylene-acrylate copolymer, polyamide resin, polyurethane resin and gelatin. Among these, alcohol-soluble polyamide resin is preferable.

The intermediate layer may contain various conductive particles or metal oxide particles in order to adjust resistance. Usable examples thereof include metal oxide particles of alumina, zinc oxide, titanium oxide, tin oxide, antimony oxide, indium oxide and bismuth oxide. The usable examples thereof also include ultrafine particles of indium oxide doped with tin, tin oxide doped with antimony, and zirconium oxide doped with antimony.

The number average primary particle diameter of the metal oxide particles is preferably 0.3 μm or less and far preferably 0.1 μm or less.

These metal oxide particles may be used individually (one type), or two or more types thereof may be mixed to use. In the case of two or more types thereof being mixed, the metal oxide particles may be in the form of a solid solution or may be fused.

The content ratio of the conductive particles or metal oxide particles is, to 100 parts by mass of the intermediate layer binder resin, preferably within a range from 20 to 400 parts by mass and far preferably within a range from 50 to 350 parts by mass.

The thickness of the intermediate layer is preferably within a range from 0.1 to 15 μm and far preferably within a range from 0.3 to 10 μm.

<Charge Producing Layer>

The charge producing layer of the photosensitive layer of the photoreceptor of the present invention contains a charge producing agent and a binder resin (hereinafter may be referred to as a "charge producing layer binder resin").

<<Charge Producing Agent>>

Examples of the charge producing agent include but are not limited to: azo pigments such as Sudan Red and Diane Blue; quinone pigments such as pyrene quinone and anthoanthrone; quinocyanine pigments; perylene pigments; indigo pigments such as indigo and thioindigo; polycyclic quinone pigments such as pyranthrone and diphthaloylpyrene; and phthalocyanine pigments. Among these, polycyclic quinone pigments and titanyl phthalocyanine pigments are preferable. These charge producing agents may be used individually (one type), or two or more types thereof may be mixed to use.

<<Charge Producing Layer Binder Resin>>

As the charge producing layer binder resin, well-known resins can be used, and examples thereof include but are not limited to: polystyrene resin; polyethylene resin; polypropylene resin; acrylic resin; methacrylic resin; vinyl chloride resin; vinyl acetate resin; polyvinyl butyral resin; epoxy resin; polyurethane resin; phenol resin; polyether resin; alkyd resin; polycarbonate resin; silicone resin; melamine resin; copolymer resin containing any two or more of these (vinyl chloride-vinyl acetate copolymer resin, vinyl chloride-vinyl acetate-maleic anhydride copolymer, etc.); and poly(vinyl carbazole) resin. Among these, polyvinyl butyral resin is preferable.

The content ratio of the charge producing agent in the charge producing layer is, to 100 parts by mass of the charge producing layer binder resin, preferably within a range from 1 to 600 parts by mass and far preferably within a range from 50 to 500 parts by mass.

Although it differs depending on the characteristics of the charge producing agent, the characteristics and the content ratio of the charge producing layer binder resin and so forth, the thickness of the charge producing layer is preferably within a range from 0.01 to 5 μm and far preferably within a range from 0.05 to 3 μm.

<Charge Transport Layer>

The charge transport layer of the photosensitive layer of the photoreceptor of the present invention contains at least a charge transport agent, a binder resin (hereinafter may be referred to as a "charge transport layer binder resin") and p-type metal oxide particles.

<<P-Type Metal Oxide Particles>>

The p-type metal oxide particles use holes (positive holes) as carriers to transport charges.

The number average primary particle diameter of the p-type metal oxide particles is preferably within a range from 15 to 200 nm and particularly preferably within a range from 20 to 50 nm.

When the number average primary particle diameter of the p-type metal oxide particles is 15 nm or more, the particles do not aggregate and have dispersibility, whereas when the number average primary particle diameter thereof is 200 nm or less, the particles do not scatter exposure light and produce images having excellent sharpness with high sensitivity.

In the present invention, the number average primary particle diameter of the p-type metal oxide particles is measured as follows: 100,000-fold enlarged pictures are taken with a scanning electron microscope (for example, JSM-7500F from JEOL Ltd.); and picture images of 300 particles (no aggregated particles included) scanned with a scanner at random are processed/analyzed with an automatic image processor LUZEX AP (software Ver. 1.32) (from Nireco Corporation) so that the number average primary particle diameter is calculated therefrom.

The added amount of the p-type metal oxide particles is, to 100 parts by mass of the charge transport layer binder resin, preferably within a range from 5 to 30 parts by mass and far preferably within a range from 15 to 25 parts by mass.

When the added amount thereof is 5 parts by mass or more, the filler effect is well demonstrated, charge transportability is excellent, the amount of the charge transport agent which acts as a plasticizer is unnecessary to increase, and film strength is prevented from decreasing, whereas when the added amount thereof is 30 parts by mass or less, resistance of the charge transport layer is prevented from decreasing, charge characteristics thereof are prevented from decreasing, and image fogging is not caused.

The p-type metal oxide particles can be produced, for example, by sintering. More specifically, in order to use $CuAlO_2$ as the p-type metal oxide particles, $Al_2O_3$ (purity: 99.9%) and $Cu_2O$ (purity: 99.9%) are mixed at a mole ratio of 1:1, calcined at 1100° C. in Ar atmosphere for four days, and then molded into pellets and sintered at 1100° C. for two days, thereby producing a sintered compact, and thereafter, the sintered compact is coarsely pulverized to be coarse particles of several 100 μm, and the produced coarse particles are finely pulverized with a solvent using a wet media dispersion-type device. Thus, $CuAlO_2$ of a desired particle diameter can be produced.

Other examples of the method for producing the p-type metal oxide particles include a plasma method. Examples of the plasma method include a DC arc plasma method, a high frequency plasma method, and a plasma jet method.

In the DC arc plasma method, metal alloy constitutes a consumable anode. Then, a plasma flame is generated from a cathode. The metal alloy of the anode is heated to be evaporated, and the vapor of the metal alloy is oxidized and cooled. Thus, the p-type metal oxide particles can be produced.

In the high frequency plasma method, thermal plasma is utilized. The thermal plasma is generated when a gas is heated by high frequency induction discharge under the atmospheric pressure. In a plasma evaporation method of the high frequency plasma method, into an inert gas plasma core, solid particles are injected, the resulting product is evaporated while it passes through the plasma, and this high-temperature vapor is subjected to quenched condensation. Thus, ultrafine particles can be obtained.

In the plasma method, arc discharge in an atmosphere of argon as an inert gas or an atmosphere of hydrogen, nitrogen or oxygen as a diatomic molecule gas produces argon plasma, hydrogen plasma or the like. The hydrogen (nitrogen or oxygen) plasma produced by dissociation of the diatomic molecule gas is rich in reactivity as compared with that produced by a molecular gas, and hence called reactive arc plasma in distinction from the inert gas plasma. In particular, the oxygen plasma method is effective as a method for producing the p-type metal oxide particles.

The p-type metal oxide particles are preferably surface-treated. On the surface of the p-type metal oxide particles, a large number of hydroxy groups are present and inhibit dispersion, so that it is desired to carry out hydrophobization.

The surface treatment on the p-type metal oxide particles is to coat the surface of the p-type metal oxide particles with an organic compound, an organic metal compound, a fluorine compound, a reactive organic silicon compound or the like.

The surface treatment on the p-type metal oxide particles can be carried out by a wet process. For example, the p-type metal oxide particles are dispersed in water to be aqueous slurry, and the aqueous slurry is mixed with water-soluble silicate, a water-soluble aluminum compound or the like, whereby the surface treatment is carried out.

In the case where sodium silicate is used as the water-soluble silicate, it can be naturalized by acid such as sulfuric acid, nitric acid, hydrochloric acid or the like. In the case where aluminum sulfate is used as the water-soluble aluminum compound, it can be naturalized by alkali such as sodium hydroxide, potassium hydroxide or the like.

In the case of the surface treatment with the reactive organic silicon compound, the reactive organic silicon compound is dissolved or suspended in an organic solvent or water, the solution or suspension is mixed with the metal oxide particles, and the mixed solution is stirred for about a few minutes to one hour. Then, as needed, after heated, the solution is filtered or the like and then dried. Thus, the metal oxide particles, the surface of which is coated with the organic silicon compound, can be produced.

In the case of the surface treatment with the fluorine compound, an organic silicon compound or the like having a fluorine atom(s) is dissolved or suspended in an organic solvent or water, the solution or suspension is mixed with the metal oxide particles, and the mixed solution is stirred for about a few minutes to one hour. Then, as needed, after heated, the solution is filtered or the like and then dried. Thus, the metal oxide particles, the surface of which is coated with the fluorine compound, can be produced.

The metal oxide particles may be further treated with silicone oil or silicone resin in order to improve slippage and surface nature.

In the present invention, the p-type metal oxide particles may be surface-treated with a surface treatment agent having a radical polymerizable functional group(s).

More specifically, the p-type metal oxide particles as a starting material (hereinafter may be referred to as "untreated p-type metal oxide particles") are surface-treated with a surface treatment agent having radical polymerizable functional groups, so that the radical polymerizable functional groups are introduced to the surface of the untreated p-type metal oxide particles.

As the surface treatment agent, a surface treatment agent reactive to hydroxy groups or the like which are present on the surface of the p-type metal oxide particles is preferable, and examples thereof include a silane coupling agent and a titanium coupling agent.

In the surface treatment agent having radical polymerizable functional groups, the radical polymerizable functional groups are vinyl groups, acryloyl groups, methacryloyl groups or the like. These radical polymerizable functional groups are excellent in dispersibility and electrical characteristics. The reason why they are excellent in electrical characteristics is not clear, but it is considered that the carbon-carbon double bond contributes to charge transportability.

The surface treatment agent having radical polymerizable functional groups is preferably a silane coupling agent having radical polymerizable functional groups being vinyl groups, acryloyl groups, methacryloyl groups or the like.

Specific examples of the surface treatment agent are shown below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)\ Cl_2$
S-11: $CH_2{=}CHCOO(CH_2)_3SiCl_3$
S-12: $CH_2{=}C(CH_3)\ COO(CH_2)_2Si(CH_3)(OCH_3)_2$
S-13: $CH_2{=}C(CH_3)\ COO(CH_2)_2Si(OCH_3)_3$
S-14: $CH_2{=}C(CH_3)\ COO(CH_2)_3Si(CH_3)(OCH_3)_2$
S-15: $CH_2{=}C(CH_3)\ COO(CH_2)_3Si(OCH_3)_3$
S-16: $CH_2{=}C(CH_3)\ COO(CH_2)_2Si(CH_3)\ Cl_2$
S-17: $CH_2{=}C(CH_3)\ COO(CH_2)_2SiCl_3$
S-18: $CH_2{=}C(CH_3)\ COO(CH_2)_3Si(CH_3)\ Cl_2$
S-19: $CH_2{=}C(CH_3)\ COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

As the surface treatment agent, other than the above compounds S-1 to S-36, a silane compound having radical polymerizable functional groups may be used.

These surface treatment agents may be used individually (one type), or two or more types thereof may be mixed to use.

The used amount of the surface treatment agent is, to 100 parts by volume of the untreated p-type metal oxide particles, preferably within a range from 5 to 30 parts by volume and far preferably within a range from 5 to 20 parts by volume.

The surface treatment is carried out, for example, by wetly crushing slurry (suspension of solid particles) containing untreated p-type metal oxide particles and a surface treatment agent. This method prevents the untreated p-type metal oxide particles from re-aggregating while surface-treating the untreated P-type metal oxide particles. Thereafter, the solvent is removed, and powdering is carried out.

A surface treatment device may be exemplified by a wet media dispersion-type device.

The wet media dispersion-type device is a device which, with a container filled with beads as media, pulverizes and disperses aggregated particles of untreated p-type metal oxide particles by rotating, at high speed, a stirring disc perpendicularly attached to a rotation axis.

The configuration thereof may be any as long as the device can sufficiently disperse untreated p-type metal oxide particles for surface treatment on the untreated p-type metal oxide particles and carry out the surface treatment, and hence there are various adoptable modes including a longitudinally-mounted type, a transversely-mounted type, a continuous system and a batch system.

To be more specific, a sand mill, an ultra visco mill, a pearl mill, a glen mill, a dyno mill, an agitator mill, a dynamic mill and so forth are usable. These dispersion-type devices carry out fine pulverization and dispersion with pulverization media such as balls and beads by impact/pressure crushing, friction, shearing, shear stress or the like.

Examples of the beads used in the wet media dispersion-type device include balls made of, as a starting material, glass, alumina, zircon, zirconia, steel and flint, and zirconia and zircon are particularly preferable. In general, beads having a diameter of about 1 to 2 mm are used, but, in the present invention, beads having a diameter of about 0.1 to 1.0 mm are preferably used.

For the disc and the inner wall of the container used in the wet media dispersion-type device, various materials such as stainless steel, nylon and ceramic can be used. In the present invention, it is particularly preferable that the disc and the inner wall of the container be made of ceramic such as zirconia or silicon carbide.

<<Charge Transport Agent>>

Examples of the charge transport agent as a substance to transport charges include a triphenylamine derivative, a hydrazone compound, a styryl compound, a benzidine compound and a butadiene compound.

To be specific, the following compound A is preferably used.

[Chem. 1]

Compound A

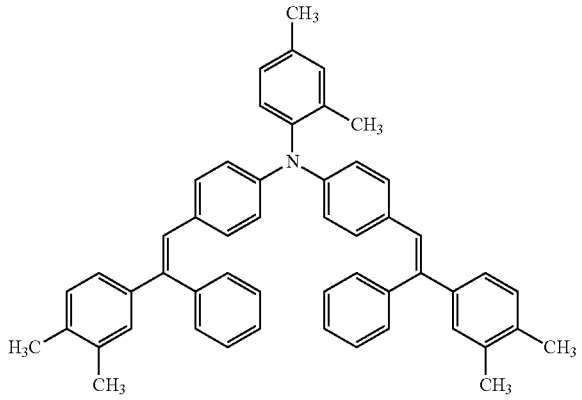

<<Charge Transport Layer Binder Resin>>

As the charge transport layer binder resin, well-known resins can be used, and examples thereof include polycarbonate resin, polyacrylate resin, polyester resin, polystyrene resin, styrene-acrylonitrile copolymer resin, polymethacrylic acid ester copolymer resin, and styrene-methacrylic acid ester copolymer resin. Among these, polycarbonate resin is preferable. Further, BPA (bisphenol A) type, BPZ (bisphenol Z) type, dimethyl BPA type, and BPA-dimethyl BPA copolymer type polycarbonate resins are preferable in view of crack resistance, wear resistance and charge characteristics.

The content ratio of the charge transport agent in the charge transport layer is, to 100 parts by mass of the charge transport layer binder resin, preferably within a range from 10 to 500 parts by mass and far preferably within a range from 20 to 250 parts by mass.

Although it differs depending on the characteristics of the charge transport agent, the characteristics and the content ratio of the charge transport layer binder resin and so forth, the thickness of the charge transport layer is preferably within a range from 5 to 40 μm and far preferably within a range from 10 to 30 μm.

Into the charge transport layer, an antioxidant, an electronic conductive agent, a stabilizer and silicone oil may be added. As the antioxidant, those described, for example, in Japanese Patent Application Publication No. 2000-305291, and as the electronic conductive agent, those described, for example, in Japanese Patent Application Publication Nos. 50-137543 and 58-76483 are preferable.

[Method for Producing Electrophotographic Photoreceptor]

The photoreceptor of the present invention can be produced by a method including, for example, the following steps:

Step (1): a step of applying an intermediate layer forming application liquid to the outer circumference of a conductive holder and drying the application liquid so as to form an intermediate layer;

Step (2): a step of applying a charge producing layer forming application liquid to the outer circumference of the intermediate layer formed on the conductive holder and drying the application liquid so as to forma charge producing layer; and Step (3): a step of applying a charge transport layer forming application liquid to the outer circumference of the charge producing layer formed on the intermediate layer and drying the application liquid so as to form a charge transport layer.

<Step (1): Formation of Intermediate Layer>

An intermediate layer can be formed by: preparing an application liquid (hereinafter may be referred to as the "intermediate layer forming application liquid") by dissolving an intermediate layer binder resin in a solvent and, as needed, dispersing conductive particles or metal oxide particles therein; applying the application liquid onto a conductive holder to be uniform thickness so as to form an applied film; and drying the applied film.

Examples of a device to disperse the conductive particles or metal oxide particles in the intermediate layer forming application liquid include but are not limited to an ultrasonic disperser, a ball mill, a sand mill and a homomixer.

As a method for applying the intermediate layer forming application liquid, well-known methods can be used, and examples thereof include immersion coating, spray coating, spinner coating, bead coating, blade coating, beam coating, a slide hopper method, and a circular slide hopper method.

A method for drying the applied film can be appropriately selected according to the type of the solvent and the thickness of the applied film, but thermal drying is preferable.

The solvent used at the step of forming an intermediate layer may be any as long as it well disperses the conductive particles or metal oxide particles and dissolves the intermediate layer binder resin. To be specific, $C_1$-$C_4$ alcohols such as methanol, ethanol, n-propyl alcohol, isopropyl alcohol, n-butanol, t-butanol and sec-butanol are preferable because they are excellent in dissolubility of the binder resin and application performance. Further, a co-solvent which is used together with the solvent in order to improve storability and dispersibility of the particles and well demonstrates preferable effects together with the solvent is exemplified by benzyl alcohol, toluene, methylene chloride, cyclohexanone and tetrahydrofuran.

The concentration of the intermediate layer binder resin in the intermediate layer forming application liquid is appropriately selected according to the thickness and the production speed of the intermediate layer.

<Step (2): Formation of Charge Producing Layer>

A charge producing layer can be formed by: preparing an application liquid (hereinafter may be referred to as the "charge producing layer forming application liquid") by dispersing a charge producing agent in a solution composed of a charge producing layer binder resin dissolved in a solvent; applying the application liquid onto the intermediate layer to be uniform thickness so as to form an applied film; and drying the applied film.

Examples of a device to disperse the charge producing agent in the charge producing layer forming application liquid include but are not limited to an ultrasonic disperser, a ball mill, a sand mill and a homomixer.

As a method for applying the charge producing layer forming application liquid, well-known methods can be used, and examples thereof include immersion coating, spray coating, spinner coating, bead coating, blade coating, beam coating, the slide hopper method, and the circular slide hopper method.

A method for drying the applied film can be appropriately selected according to the type of the solvent and the thickness of the applied film, but thermal drying is preferable.

Examples of the solvent used for forming the charge producing layer include but are not limited to toluene, xylene, methylene chloride, 1,2-dichloroethane, methyl ethyl ketone, cyclohexanone, ethyl acetate, t-butyl acetate, methanol, ethanol, propanol, butanol, methyl cellosolve, 4-methoxy-4-methyl-2-pentanone, ethyl cellosolve, tetrahydrofuran, 1,4-dioxane, 1,3-dioxolane, pyridine and diethylamine.

<Step (3): Formation of Charge Transport Layer>

A charge transport layer can be formed by: preparing an application liquid (hereinafter may be referred to as the "charge transport layer forming application liquid") by dissolving a charge transport layer binder resin, a charge transport agent and p-type metal oxide particles in a solvent; applying the application liquid onto the charge producing layer to be uniform thickness so as to form an applied film; and drying the applied film.

As a method for applying the charge transport layer forming application liquid, well-known methods can be used, and examples thereof include immersion coating, spray coating, spinner coating, bead coating, blade coating, beam coating, the slide hopper method, and the circular slide hopper method.

A method for drying the applied film can be appropriately selected according to the type of the solvent and the thickness of the applied film, but thermal drying is preferable.

Examples of the solvent used for forming the charge transport layer include but are not limited to toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine and diethylamine.

[Image Forming Apparatus and Image Forming Method]

The photoreceptor of the present invention can be disposed in a general electrophotographic image forming apparatus. The photoreceptor of the present invention can also be suitably used in an image forming method using the image forming apparatus.

Hereinafter, the image forming apparatus and the image forming method are described.

The image forming apparatus of the present invention includes, for example, a photoreceptor(s), a charging section(s) which charges the surface of the photoreceptor, an exposure section(s) which forms electrostatic latent images on the surface of the photoreceptor, a development section(s) which develops the electrostatic latent images with a toner(s) so as to form toner images, a transfer section(s) which transfers the toner images to a transfer material, a fixing section which fixes the toner images transferred to the transfer material, and a cleaning section (s) which removes the remaining toner on the photoreceptor.

FIGURE 1 is a cross sectional view showing an example of the configuration of an image forming apparatus provided with the photoreceptor of the present invention.

This image forming apparatus is called a tandem color-image forming apparatus and includes: four image forming sections (image forming units) 10Y, 10M, 10C and 10Bk; an endless belt-shaped intermediate transfer body unit 7; a paper feed section 21; and a fixing section 24. On the upper side of a main body A of the image forming apparatus, a scanner device SC which scans images on documents is disposed.

The image forming section 10Y which forms yellow images includes: a drum-shaped photoreceptor 1Y; and a charging section 2Y, an exposure section 3Y, a development section 4Y, a primary transfer roller 5Y as a primary transfer section, and a cleaning section 6Y which are disposed around the photoreceptor 1Y.

The image forming section 10M which forms magenta images includes: a drum-shaped photoreceptor 1M; and a charging section 2M, an exposure section 3M, a development section 4M, a primary transfer roller 5M as a primary transfer section, and a cleaning section 6M which are disposed around the photoreceptor 1M.

The image forming section 10C which forms cyan images includes: a drum-shaped photoreceptor 1C; and a charging section 2C, an exposure section 3C, a development section 4C, a primary transfer roller 5C as a primary transfer section, and a cleaning section 6C which are disposed around the photoreceptor 1C.

The image forming section 10Bk which forms black images includes: a drum-shaped photoreceptor 1Bk; and a charging section 2Bk, an exposure section 3Bk, a development section 4Bk, a primary transfer roller 5Bk as a primary transfer section, and a cleaning section 6Bk which are disposed around the photoreceptor 1Bk.

The image forming apparatus of the present invention uses the photoreceptor of the present invention as each of the photoreceptors 1Y, 1M, 1C and 1Bk.

As described above, the four image forming units 10Y, 10M, 10C and 10Bk respectively include: around the photoreceptors 1Y, 1M, 1C and 1Bk, the charging sections 2Y, 2M, 2C and 2Bk; the exposure sections 3Y, 3M, 3C and 3Bk; the development sections 4Y, 4M, 4C and 4Bk which rotate; and the cleaning sections 6Y, 6M, 6C and 6Bk which respectively clean the photoreceptors 1Y, 1M, 1C and 1Bk.

The image forming units 10Y, 10M, 10C and 10Bk have the same configuration except that colors of toner images respectively formed on the photoreceptors 1Y, 1M, 1C and 1Bk are different. Hence, the image forming unit 10Y is detailed below as an example.

The image forming unit 10Y includes the charging section 2Y, the exposure section 3Y, the development section 4Y and the cleaning section 6Y which are disposed around the photoreceptor 1Y as an image-formed body (a first image holder) and forms yellow (Y) toner images on the photoreceptor 1Y. In the embodiment, of the image forming unit 10Y, at least the photoreceptor 1Y, the charging section 2Y, the development section 4Y and the cleaning section 6Y are disposed in such a way as to be united.

The charging section 2Y is a section to uniformly apply electric potentials to the photoreceptor 1Y. In the present invention, the charging section 2Y is exemplified by a charging section employing a system of charging with a contact or contactless roller.

The exposure section 3Y carries out exposure, on the basis of image signals (yellow), on the photoreceptor 1Y to which electric potentials are uniformly applied by the charging section 2Y so as to form electrostatic latent images corresponding to yellow images. The exposure section 3Y is exemplified by: an exposure section composed of LEDs as light emitting elements disposed in an array in the axial direction of the photoreceptor 1Y and image forming elements disposed in relation to the LEDs; and a laser optical exposure section.

The development section 4Y includes: a rotational development sleeve having a built-in magnet and storing a developer in itself; and a voltage application device applying DC and/or AC bias voltages to between the photoreceptor 1Y and the development sleeve.

The fixing section 24 is exemplified by a fixing section employing a system of fixation with a heat roller and composed of a heat roller having a heat source therein and a pressure roller being in contact with the heat roller by pressure so as to form a fixing nip part with the heat roller.

The cleaning section 6Y includes a cleaning blade and a brush roller disposed on the upstream side of the cleaning blade.

The image forming apparatus may be configured in such a way that components such as photoreceptors, development sections and cleaning sections are integrated into a process cartridge (image forming units) and the image forming units are attachable/detachable to/from a main body of the apparatus. Alternatively, the image forming apparatus may be configured in such a way that at least one of a charging section, an exposure section, a development section, a transfer section and a cleaning section is united with a photoreceptor so as to constitute a process cartridge (image forming unit) as a monochrome-image forming unit which is attachable/detachable to/from a main body of the apparatus along a guide section, such as a rail(s), of the main body.

The endless belt-shaped intermediate transfer body unit 7 has an endless belt-shaped intermediate body 70 as a second image holder which is semi-conductive, endless belt-shaped, stretched around rollers and supported thereby in such a way as to be rotatable.

The toner images of the respective colors formed by the image forming units 10Y, 10M, 10C and 10Bk are successively transferred onto the rotating endless belt-shaped intermediate transfer body 70 by the primary transfer rollers 5Y, 5M, 5C and 5Bk as the primary transfer sections so as to form a color image constituted of the toner images of the respective colors being combined.

The transfer material (image support holding the fixed final image(s), such as plain paper and transparent sheets) P housed in a paper feed cassette 20 is fed by the paper feed section 21 so as to be carried to a secondary transfer roller 5*b* as a secondary transfer section through intermediate rollers 22A, 22B, 22C and 22D and a resist roller 23, and the color image is secondary-transferred onto the transfer material P by the secondary transfer roller 5*b*. The transfer material P having the color image transferred thereonto is subjected to fixation with the fixing section 24 and held by and sandwiched between paper ejection rollers 25 so as to be placed on a paper ejection tray 26 attached to the outside of the image forming apparatus. In this application, the intermediate transfer body and the transfer material, which are transfer supports of the toner images formed on the photoreceptors, are given a general term of transfer media.

Meanwhile, the remaining toners on the endless belt-shaped intermediate transfer body 70 are removed by a cleaning section 6*b* after the endless belt-shaped intermediate transfer body 70 transfers the color image onto the transfer material P with the secondary transfer roller 5*b* as the secondary transfer section and performs self stripping to release the transfer material P.

During image formation, the primary transfer roller 5Bk always abuts the photoreceptor 1Bk, whereas the other primary transfer rollers 5Y, 5M and 5C abut their corresponding photoreceptors 1Y, 1M and 1C only when the color image is formed.

The secondary transfer roller 5*b* abuts the endless belt-shaped intermediate transfer body 70 only when the transfer material P passes through the secondary transfer roller 5*b* so as to be secondary-transferred.

A housing 8 can be pulled out from the main body A along supporting rails 82L and 82R.

The housing 8 houses the image forming sections 10Y, 10M, 10C and 10Bk and the endless belt-shaped intermediate transfer body unit 7.

The image forming sections 10Y, 10M, 10C and 10Bk are disposed in vertical direction. On the left of the photoreceptors 1Y, 1M, 1C and 1Bk in FIGURE 1, the endless belt-shaped intermediate transfer body unit 7 is disposed.

The endless belt-shaped intermediate transfer body unit 7 includes the endless belt-shaped intermediate transfer body 70 which is stretched around rollers 71, 72, 73 and 74 and supported thereby in such a way as to be rotatable, the primary transfer rollers 5Y, 5M, 5C and 5Bk, and the cleaning section 6*b*.

FIGURE 1 shows, as the image forming apparatus, a color laser printer, but a monochrome laser printer and a copier are also applicable. Further, as the exposure light source, light sources other than the laser, such as an LED light source, may be used.

The toners used in the above-described image forming apparatus are not particularly limited, but preferably toners having a shape factor SF of less than 140 taking that of a true sphere as 100. When the shape factor SF is less than 140, excellent transferability and so forth are obtained and the quality of the produced images is increased. Toner particles constituting the toners preferably have a volume average particle diameter of 2 to 8 μm in order to increase image quality.

The toner particles usually contain a binder resin and a colorant and contain, as desired, a release agent. The binder resin, colorant and release agent are not particularly limited, and materials used for conventional toners can be used therefor.

A method for producing the toner particles is not particularly limited, and examples thereof include: normal pulverization; wet-type fusion-and-sphering, which produces toner particles in a dispersion medium; and well-known polymerizations such as suspension polymerization, dispersion polymerization and emulsion polymerization aggregation.

To the toner particles, inorganic particles of silica, titanium or the like as an external additive having an average particle diameter of about 10 to 300 nm and an abrasive having an average particle diameter of about 0.2 to 3 μm can be added at appropriate amounts. The toner particles may be mixed with carriers composed of ferrite beads or the like having an average particle diameter of 25 to 45 μm so as to form a two-component developer to use.

As described above, according to the present invention, there can be provided an electrophotographic photoreceptor, an electrophotographic image forming method and an electrophotographic image forming apparatus to realize high durability by increasing film strength while maintaining electrical characteristics of a charge transport layer.

Although appearance mechanism of the effects of the present invention and action mechanism thereof are not clear yet, speculation thereon is made as follows.

Adding p-type metal oxide particles into a charge transport layer can reduce a charge transport agent to the minimal amount and significantly increase film strength as compared with a conventional charge transport layer and thereby realize high durability. In addition, providing no surface layer forms no interface between a surface layer and the charge transport layer and thereby allows smooth transport of charges and produces a photoreceptor excellent in electrical characteristics.

EXAMPLES

Hereinafter, the present invention is more specifically described with Examples. However, the present invention is not limited thereto. Note that "parts" and "percent (or %)" used in Examples stand for "parts by mass" and "percent by mass (or mass %)", respectively, unless otherwise specified.

<Production of Metal Oxide Particles [A]>

$Al_2O_3$ (purity: 99.9%) and $Cu_2O$ (purity: 99.9%) were mixed at a mole ratio of 1:1, calcined at 1100° C. in Ar atmosphere for four days, and then molded into pellets and sintered at 1100° C. for two days, thereby producing a sintered compact. Thereafter, the sintered compact was coarsely pulverized to be particles of several 100 μm, and the produced coarse particles were finely pulverized with a solvent using a wet media dispersion-type device. Thus, particles [A] composed of $CuAlO_2$ and having a number average primary particle diameter of 20 nm were produced.

100 parts by mass of the produced particles [A], 7 parts by mass of the above S-15 compound as a surface treatment agent and 1000 parts by mass of methyl ethyl ketone were placed in a wet sand mill (alumina beads having a diameter of 0.5 mm), mixed at 30° C. for six hours, and then filtered to remove methyl ethyl ketone and alumina beads and dried at 60° C. Thus, metal oxide particles [A] were produced.

<Production of Metal Oxide Particles [B]>

$Ga_2O_3$ (purity: 99.9%) and $Cu_2O$ (purity: 99.9%) were mixed at a mole ratio of 1:1, calcined at 1100° C. in Ar atmosphere for four days, and then molded into pellets and sintered at 1100° C. for two days, thereby producing a sintered compact. Thereafter, the sintered compact was coarsely pulverized to be particles of several 100 μm, and the produced coarse particles were finely pulverized with a solvent using a wet media dispersion-type device. Thus, particles [B] composed of $CuGaO_2$ and having a number average primary particle diameter of 50 nm were produced.

100 parts by mass of the produced particles [B], 7 parts by mass of the above S-15 compound as a surface treatment agent and 1000 parts by mass of methyl ethyl ketone were placed in a wet sand mill (alumina beads having a diameter of 0.5 mm), mixed at 30° C. for six hours, and then filtered to remove methyl ethyl ketone and alumina beads and dried at 60° C. Thus, metal oxide particles [B] were produced.

<Production of Metal Oxide Particles [C]>

$In_2O_3$ (purity: 99.9%) and $Cu_2O$ (purity: 99.9%) were mixed at a mole ratio of 1:1, calcined at 1100° C. in Ar atmosphere for four days, and then molded into pellets and sintered at 1100° C. for two days, thereby producing a sintered compact. Thereafter, the sintered compact was coarsely pulverized to be particles of several 100 μm, and the produced coarse particles were finely pulverized with a solvent using a wet media dispersion-type device. Thus, particles [C] composed of $CuInO_2$ and having a number average primary particle diameter of 20 nm were produced.

100 parts by mass of the produced particles [C], 7 parts by mass of the above S-6 compound as a surface treatment agent and 1000 parts by mass of methyl ethyl ketone were placed in a wet sand mill (alumina beads having a diameter of 0.5 mm), mixed at 30° C. for six hours, and then filtered to remove methyl ethyl ketone and alumina beads and dried at 60° C. Thus, metal oxide particles [C] were produced.

<Production of Metal Oxide Particles [D]>

100 parts by mass of $Cu_2O$ having a number average primary particle diameter of 20 nm, 30 parts by mass of KBM-503 as a polymerizable surface treatment agent and 1000 parts by mass of methyl ethyl ketone were placed in a wet sand mill (alumina beads having a diameter of 0.5 mm), mixed at 30° C. for six hours, and then filtered to remove methyl ethyl ketone and alumina beads and dried at 60° C. Thus, metal oxide particles [D] were produced.

<Production of Photoreceptor [1]>

The surface of an cylindrical alumina body having a diameter of 80 mm was subjected to machining (cutting), whereby a conductive holder [1] having a rough surface produced by fine machining was prepared.

<<Formation of Intermediate Layer>>

100 parts by mass of polyamide resin CM8000 (from Toray Industries, Inc.) as a binder resin was added to 1700 parts by mass of a mixed solvent composed of ethanol/n-propyl alcohol/tetrahydrofuran (volume ratio of 45/20/35) and stirred at 20° C. to be mixed. 200 parts by mass of titanium oxide particles SMT500SAS (from Tayca Corporation) and 140 parts by mass of titanium oxide particles SMT150MK (from Tayca Corporation) were added to the solution and dispersed therein with a bead mill taking five hours as a stay time in the mill. This solution was still stood for 24 hours and then filtered. Thus, an intermediate layer forming application liquid was produced. The filtration was carried out at a pressure of 50 kPa using, as a filtration filter, a Rigimesh filter (from Pall Corporation) having a nominal filtration accuracy of 5 μm. The thus-produced intermediate layer forming application liquid was applied to the outer circumference of the washed conductive holder [1] by immersion coating and dried at 120° C. for 30 minutes. Thus, an intermediate layer having a dry thickness of 2 μm was formed.

<<Formation of Charge Producing Layer>>

20 parts by mass of titanyl phthalocyanine pigment (titanyl phthalocyanine pigment having a maximum diffraction peak at least at 27.3° in Cu—Kα characteristic X-ray diffraction spectrum measurement) as a charge producing agent, 10 parts by mass of polyvinyl butyral resin #6000-C (from DENKI KAGAKU KOGYO KABUSHIKI KAISHA) as a binder resin, and 700 parts by mass of t-butyl acetate and 300 parts by mass of 4-methoxy-4-methyl-2-pentanone as solvents were mixed and dispersed for 10 hours with a sand mill. Thus, a charge producing layer forming application liquid was prepared. This charge producing layer forming application liquid was applied onto the intermediate layer by immersion coating. Thus, a charge producing layer having a dry thickness of 0.3 μm was formed.

<<Preparation of Dispersion of Metal Oxide Particles [A]>>

100 parts by mass of the metal oxide particles [A], and 320 parts by mass of tetrahydrofuran and 80 parts by mass of toluene as solvents were stirred to be mixed and sufficiently dispersed. Thus, a dispersion of metal oxide particles [A] (dispersion containing 20 mass % of the metal oxide particles [A]) was prepared.

<<Formation of Charge Transport Layer [1]>>

75 parts by mass of the prepared dispersion of metal oxide particles [A], 120 parts by mass of the above compound A as a charge transport agent, 300 parts by mass of polycarbonate resin Z300 (from Mitsubishi Gas Chemical Company, Inc.) as a binder resin, 6 parts by mass of Irganox1010 (from BASF Japan Ltd.) as an antioxidant, 2190 parts by mass of a mixed solvent composed of tetrahydrofuran/toluene (4/1) as a solvent and 0.3 parts by mass of silicone oil KF-54 (from Shin-Etsu Chemical Co., Ltd.) were mixed and dissolved. Thus, a charge transport layer forming application liquid was prepared. This charge transport layer forming application liquid was applied onto the charge producing layer by immersion coating. Thus, a charge transport layer [1] having a dry thickness of 30 μm was formed, and consequently a photoreceptor [1] was produced.

<Production of Photoreceptors [2] to [8]>

Photoreceptors [2] to [8] were produced in the same way as the photoreceptor [1] until charge producing layers were formed, and dispersions of metal oxide particles were prepared and charge transport layers were formed as follows.

<<Preparation of Dispersions of Metal Oxide Particles [B] to [D]>>

Dispersions of metal oxide particles [B] to [D] were prepared in the same way as the dispersion of metal oxide particles [A] except that the metal oxide particles [A] were changed to the metal oxide particles [B] to [D].

<<Formation of Charge Transport Layers [2] to [8]>>

Charge transport layers [2] to [8] were formed in the same way as the charge transport layer [1] except that the type of the dispersion of metal oxide particles and the added amounts of the dispersion of metal oxide particles, charge transport agent and tetrahydrofuran/toluene (4/1) were changed to those shown in TABLE 1 below, and consequently photoreceptors [2] to [8] were produced.

<Production of Photoreceptors [9] to [13]>

Photoreceptors [9] to [13] were produced in the same way as the photoreceptor [1] until charge producing layers were formed, and dispersions of metal oxide particles were prepared and charge transport layers were formed as follows.

<<Production of Metal Oxide Particles [E]>>

Using tin oxide A having a number average primary particle diameter of 20 nm and a volume resistivity of $1.05\times10^5$ Ω·cm (from CIK Nanotek Corporation) as metal oxide particles and the above compound S-15 as a compound having radical polymerizable functional groups, surface treatment with a compound having radical polymerizable functional groups was carried out as follows.

First, a mixed solution composed of 100 parts by mass of tin oxide A, 30 parts by mass of the above compound S-15 as a surface treatment agent and 300 parts by mass of a mixed solvent composed of toluene/isopropyl alcohol (mass ratio of 1/1) was placed together with zirconia beads in a sand mill and stirred at about 40° C. at a rotational speed of 1500 rpm so as to carry out surface treatment with a compound having radical polymerizable functional groups. The treated mixture was taken out therefrom, placed in a Henschel mixer, stirred at a rotational speed of 1500 rpm for 15 minutes and then dried at 120° C. for three hours, whereby the surface treatment with a compound having radical polmerizable functional groups on the tin oxide was completed. Thus, surface-treated metal oxide particles [E] (surface-treated tin oxide A) were produced. Through the surface treatment with a compound having radical polymeriable functional groups, the particle surface of the tin oxide A was coated with the compound S-15.

<<Production of Metal Oxide Particles [F]>>

As metal oxide particles, silica particles RX-50 (from Nippon Aerosil Co., Ltd.) were used.

<<Production of Metal Oxide Particles [G]>>

As metal oxide particles, alumina particles AKP-50 (from Sumitomo Chemical Co., Ltd.) were used.

<<Preparation of Dispersions of Metal Oxide Particles [E] to [G]>>

Dispersions of metal oxide particles [E] to [G] were prepared in the same way as the dispersion of metal oxide particles [A] except that the metal oxide particles [A] were changed to the metal oxide particles [E] to [G].

<<Formation of Charge Transport Layers [9] to [13]>>

Charge transport layers [9] to [13] were formed in the same way as the charge transport layer [1] except that the type of the dispersion of metal oxide particles and the added amounts of the dispersion of metal oxide particles, charge transport agent and tetrahydrofuran/toluene (4/1) were changed to those shown in TABLE 1 below, and consequently photoreceptors [9] to [13] were produced. For the photoreceptor [12], polycarbonate resin Z500 (from Mitsubishi Gas Chemical Company, Inc.) was used.

TABLE 1

| | METAL OXIDE PARTICLE | | | | | CHARGE TRANSPORT AGENT | |
|---|---|---|---|---|---|---|---|
| | DISPERSION | | | | | | |
| PHOTORECEPTOR No. | No. | TYPE | ADDED AMOUNT (20 mass %) | CONTENT (parts by mass) | CONTENT % (TO RESIN) | ADDED AMOUNT (parts by mass) | CONTENT % (TO RESIN) |
| [1] | A | $CuAlO_2$ | 75 | 15 | 5 | 120 | 40 |
| [2] | A | $CuAlO_2$ | 150 | 30 | 10 | 120 | 40 |
| [3] | A | $CuAlO_2$ | 300 | 60 | 20 | 90 | 30 |
| [4] | A | $CuAlO_2$ | 375 | 75 | 25 | 60 | 20 |
| [5] | A | $CuAlO_2$ | 450 | 90 | 30 | 60 | 20 |
| [6] | B | $CuGaO_2$ | 300 | 60 | 20 | 90 | 30 |
| [7] | C | $CuInO_2$ | 300 | 60 | 20 | 90 | 30 |
| [8] | D | $Cu_2O$ | 300 | 60 | 20 | 90 | 30 |
| [9] | — | — | 0 | 0 | 0 | 150 | 50 |
| [10] | E | SnO2 | 150 | 30 | 10 | 120 | 40 |
| [11] | F | SiO2 | 300 | 60 | 20 | 150 | 50 |
| [12] | F | $SiO_2$ | 300 | 60 | 20 | 90 | 30 |
| [13] | G | $Al_2O_3$ | 300 | 60 | 20 | 90 | 30 |

TABLE 1-continued

| PHOTORECEPTOR No. | POLYCARBONATE RESIN TYPE | POLYCARBONATE RESIN ADDED AMOUNT (parts by mass) | ANTIOXIDANT ADDED AMOUNT (parts by mass) | TETRAHYDROFURAN/TOLUENE (4/1) ADDED AMOUNT (parts by mass) | REMARK |
|---|---|---|---|---|---|
| [1] | Z300 | 300 | 6 | 2190 | *1 |
| [2] | Z300 | 300 | 6 | 2130 | *1 |
| [3] | Z300 | 300 | 6 | 2010 | *1 |
| [4] | Z300 | 300 | 6 | 1950 | *1 |
| [5] | Z300 | 300 | 6 | 1890 | *1 |
| [6] | Z300 | 300 | 6 | 2010 | *1 |
| [7] | Z300 | 300 | 6 | 2010 | *1 |
| [8] | Z300 | 300 | 6 | 2010 | *1 |
| [9] | Z300 | 300 | 6 | 2250 | *2 |
| [10] | Z300 | 300 | 6 | 2130 | *2 |
| [11] | Z300 | 300 | 6 | 2010 | *2 |
| [12] | Z500 | 300 | 6 | 2460 | *2 |
| [13] | Z300 | 300 | 6 | 2010 | *2 |

| PHOTO-RECEPTOR No. | EVALUATION RESULT: POTENTIAL VARIATION Vo VARIATION (V) | Vo VARIATION EVALUATION | Vi VARIATION (V) | Vi VARIATION EVALUATION | WEAR RESISTANCE α VALUE (μm) | WEAR RESISTANCE EVALUATION | APPLICATION UNIFORMITY THICKNESS DEVIATION (μm) | APPLICATION UNIFORMITY EVALUATION | REMARK |
|---|---|---|---|---|---|---|---|---|---|
| [1] | −12 | ○ | +21 | ○ | 0.58 | Δ | 0.70 | ○ | EXAMPLE |
| [2] | −14 | ○ | +11 | ○ | 0.49 | Δ | 0.82 | ○ | EXAMPLE |
| [3] | −19 | ○ | +14 | ○ | 0.23 | ○ | 0.75 | ○ | EXAMPLE |
| [4] | −32 | ○ | +33 | ○ | 0.19 | ○ | 0.77 | ○ | EXAMPLE |
| [5] | −45 | Δ | +27 | ○ | 0.13 | ○ | 0.88 | ○ | EXAMPLE |
| [6] | −27 | ○ | +12 | ○ | 0.25 | ○ | 0.71 | ○ | EXAMPLE |
| [7] | −33 | ○ | +19 | ○ | 0.26 | ○ | 0.78 | ○ | EXAMPLE |
| [8] | −23 | ○ | +29 | ○ | 0.21 | ○ | 0.75 | ○ | EXAMPLE |
| [9] | −7 | ○ | +15 | ○ | 1.12 | x | 0.68 | ○ | COMPARATIVE EXAMPLE |
| [10] | −120 | x | +25 | ○ | 0.68 | x | 0.94 | ○ | COMPARATIVE EXAMPLE |
| [11] | −12 | ○ | +18 | ○ | 0.71 | x | 0.73 | ○ | COMPARATIVE EXAMPLE |
| [12] | −15 | ○ | +57 | x | 0.34 | ○ | 2.86 | x | COMPARATIVE EXAMPLE |
| [13] | −5 | ○ | +112 | x | 0.31 | ○ | 0.98 | ○ | COMPARATIVE EXAMPLE |

*1: EXAMPLE
*2: COMPARATIVE EXAMPLE

In TABLE 1, the content (parts by mass) under the column "Metal Oxide Particle" indicates parts by mass of metal oxide particles in a dispersion (20 mass %) of metal oxide particles (e.g., in the case of the photoreceptor [1], 75 parts by mass×20 mass %=15 parts by mass).

The content % (to resin) under the column "Metal Oxide Particle" indicates content % of metal oxide particles in a dispersion (20 mass %) of metal oxide particles to the added amount (parts by mass) of polycarbonate resin (e.g., in the case of the photoreceptor [1], 15 parts by mass/300 parts by mass ×100=5%).

The content % (to resin) under the column "Metal Oxide Particle" indicates content % of a charge transport agent to the added amount (parts by mass) of polycarbonate resin (e.g., in the case of the photoreceptor [1], 120 parts by mass/300 parts by mass×100=40%).

<Evaluation>

As an evaluation device, bizhub PRESS C8000 (from Konica Minolta, Inc.) was used, and each of the produced photoreceptors was installed in this evaluation device so as to be evaluated.

Under the environment of a temperature of 23° C. and a humidity of 50% RH, the evaluation device equipped with each photoreceptor was subjected to a durability test of continuously printing a text image having an image area ratio of 6% on both sides of 500,000 sheets of A4 paper in transverse feed. Before and after the durability test, measurements were carried out to evaluate potential variations and wear resistance of each photoreceptor. The evaluation result is shown in TABLE 2 below.

(1) Evaluation of Potential Variation

Before and after the durability test, under the environment of a temperature of 10° C. and a humidity of 15% RH, while each photoreceptor was rotated at 130 rpm, charge potentials (Vo) and after-exposure potentials (Vi) were obtained under the conditions of a grid voltage of −700 V and an exposure of 0.4 μJ/cm$^2$. The potential variations were evaluated according to the following criteria; with respect to each of Vo and Vi, the absolute value of the variation between before and after the durability test of 50 V or less is evaluated as "○ (excellent), and the absolute value thereof of more than 50 V is evaluated as "x (bad)".

(2) Evaluation of Wear Resistance

Before and after the durability test, thickness of the photosensitive layer (the charge producing layer and the charge transport layer) of each photoreceptor was measured, and the difference therebetween was calculated as a thickness depletion amount to evaluate wear resistance. For the thickness, the measurement was carried out at 10 points (the first 20 mm (front-end part) and the last 20 mm (rear-end part) formed by application were excluded), and the average value thereof was taken as the thickness. As a thickness measuring device, an eddy current thickness measuring device EDDY560C (from Helmut Fischer GmbH Co.) was used. As an evaluation value of wear resistance, the depletion amount (μm) by 100,000 rotations of each photoreceptor is shown as an a value in TABLE 2. The α value of less than 0.3 is evaluated as "○ (excellent)", the α value of 0.3 or more and less than 0.6 is evaluated as "Δ (satisfactory)", and the α value of 0.6 or more is evaluated as "x (bad)".

(3) Evaluation of Application Uniformity

The difference between the maximum value and the minimum value of the values of the thickness measured at 10 points before the durability test for the above evaluation of wear resistance is shown as a thickness deviation to evaluate application uniformity. The thickness deviation of 1.0 μm or less is evaluated as "○ (excellent)", and the thickness deviation of more than 1.0 μm is evaluated as "x (bad)".

[Table 2]

TABLE 2

| | EVALUATION RESULT | | | | | | | | |
|---|---|---|---|---|---|---|---|---|---|
| | POTENTIAL VARIATION | | | | WEAR RESISTANCE | | APPLICATION UNIFORMITY | | |
| PHOTO- | Vo VARIATION | | Vi VARIATION | | α | | THICKNESS | | |
| RECEPTOR No. | (V) | EVAL-UATION | (V) | EVAL-UATION | VALUE (μ m) | EVAL-UATION | DEVIATION (μ m) | EVAL-UATION | REMARK |
| [1] | −12 | ○ | +21 | ○ | 0.58 | Δ | 0.70 | ○ | EXAMPLE |
| [2] | −14 | ○ | +11 | ○ | 0.49 | Δ | 0.82 | ○ | EXAMPLE |
| [3] | −19 | ○ | +14 | ○ | 0.23 | ○ | 0.75 | ○ | EXAMPLE |
| [4] | −32 | ○ | +33 | ○ | 0.19 | ○ | 0.77 | ○ | EXAMPLE |
| [5] | −45 | Δ | +27 | ○ | 0.13 | ○ | 0.88 | ○ | EXAMPLE |
| [6] | −27 | ○ | +12 | ○ | 0.25 | ○ | 0.71 | ○ | EXAMPLE |
| [7] | −33 | ○ | +19 | ○ | 0.26 | ○ | 0.78 | ○ | EXAMPLE |
| [8] | −23 | ○ | +29 | ○ | 0.21 | ○ | 0.75 | ○ | EXAMPLE |
| [9] | −7 | ○ | +15 | ○ | 1.12 | X | 0.68 | ○ | COMPARATIVE EXAMPLE |
| [10] | −120 | X | +25 | ○ | 0.68 | X | 0.94 | ○ | COMPARATIVE EXAMPLE |
| [11] | −12 | ○ | +18 | ○ | 0.71 | X | 0.73 | ○ | COMPARATIVE EXAMPLE |
| [12] | −15 | ○ | +57 | X | 0.34 | ○ | 2.86 | X | COMPARATIVE EXAMPLE |
| [13] | −5 | ○ | +112 | X | 0.31 | ○ | 0.98 | ○ | COMPARATIVE EXAMPLE |

It is known from the result shown in TABLE 2 that the photoreceptors [1] to [8] were smaller in potential variations between before and after the durability test, better in wear resistance and smaller in thickness deviation than the photoreceptors [9] to [13].

This application is based upon and claims the benefit of priority under 35 USC 119 of Japanese Patent Application No. 2014-117418 filed Jun. 6, 2014, the entire disclosure of which, including the specification, claims, drawing(s) and abstract, is incorporated herein by reference in its entirety.

What is claimed is:

1. An electrophotographic photoreceptor comprising:

a conductive holder; and at least a charge producing layer and a charge transport layer disposed on the conductive holder in order, wherein the charge transport layer contains at least a binder resin, a charge transport agent, and a metal oxide particle, an amount of the charge transport agent added in the charge transport layer is from 20 to 40 parts by mass with respect to 100 parts by mass of the binder resin, an amount of the metal oxide particles added in the charge transport layer is from 5 to 30 parts by mass with respect to 100 parts by mass of the binder resin, and the metal oxide particle contains at least one compound selected from the group consisting of $CuAlO_2$, $CuGaO_2$, $CuInO_2$ and $Cu_2O$.

2. The electrophotographic photoreceptor according to claim 1, wherein the charge transport layer is an outermost layer of the electrophotographic photoreceptor.

3. An electrophotographic image forming method comprising:

charging the electrophotographic photoreceptor according to claim 1;

exposing the photoreceptor to produce an electrostatic latent image; and developing the electrostatic latent image with a toner on the photoreceptor.

4. An electrophotographic image forming apparatus comprising the electrophotographic photoreceptor according to claim 1.

* * * * *